US007153161B2

(12) United States Patent
Huang

(10) Patent No.: US 7,153,161 B2
(45) Date of Patent: Dec. 26, 2006

(54) COAXIAL CONNECTOR

(75) Inventor: Chin Fa Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,174

(22) Filed: Dec. 28, 2004

(65) Prior Publication Data

US 2005/0159045 A1 Jul. 21, 2005

(30) Foreign Application Priority Data

Jan. 16, 2004 (TW) ..... 93200844 U

(51) Int. Cl.
*H01R 9/05* (2006.01)

(52) U.S. Cl. ..... 439/583

(58) Field of Classification Search ..... 439/584, 439/578, 579, 583

See application file for complete search history.

(56) References Cited

U.S. PATENT DOCUMENTS 6,331,123 B1 * 12/2001 Rodrigues ..... 439/584
6,425,782 B1 7/2002 Holland
6,676,446 B1 * 1/2004 Montena ..... 439/583
6,790,083 B1 * 9/2004 Chen ..... 439/583
6,926,555 B1 * 8/2005 Nelson ..... 439/578
6,929,508 B1 * 8/2005 Holland ..... 439/579
2003/0224657 A1 * 12/2003 Malloy ..... 439/578

* cited by examiner

*Primary Examiner*—Tulsidas C. Patel
*Assistant Examiner*—Harshad C Patel
(74) *Attorney, Agent, or Firm*—Wei Te Chung

(57) ABSTRACT

A coaxial connector (1) to be connected to a coaxial cable (8) includes a nut (2), a sleeve (3), a seal (4), a clamp (5) and a ferrule (6). The coaxial cable includes a cable center conductor (80), a cable dielectric layer (81), a cable outer conductor (82) and a cable jacket (83). The sleeve includes a tubular portion (31) inserted between the cable dielectric layer and the cable outer conductor, and an outer flange (32) fixed by the nut. The clamp has a clamp portion (50) enclosing the sleeve and a serrate inner wall (53). The ferrule includes an inner surface slidingly engaged the cable jacket and an outer surface has a plurality of saw-teeth (65) for matching with the serrate inner wall of the clamp.

9 Claims, 4 Drawing Sheets

COAXIAL CONNECTOR

BACKGROUND OF THE INVENTION

1. Field of the Invention

The present invention relates generally to a connector, and more particularly to a coaxial connector associated with RF communication systems.

2. Description of the Prior Art

Connectors associated with RF communication systems typically use coaxial cable systems to conduct RF signals from one point to another. These coaxial cable systems often employ coaxial connectors at their ends to connect to other coaxial cable systems or various RF circuit assemblies.

Typically, a coaxial connector has an inner contact for electrically connecting with a center conductor of the coaxial cable and an outer contact for electrically contacting with an outer conductor of the coaxial cable.

Many a method of connecting the coaxial cable and the coaxial connector are described in prior arts. For example, U.S. Pat. No. 4,921,447 discloses a connector employing a direct solder connection of the outer contact and the outer conductor. Such direct solder attachment, however, has often been a production problem because of the complex equipment required for soldering and the difficulty in operating complex equipment.

A coaxial connector employing a radial compression crimping to electrically and mechanically connecting with the outer conductor of the coaxial transmission line is disclosed in U.S. Pat. No. 6,607,399. However, an additional crimping tool is needed.

An improved coaxial connector is disclosed in Europe Patent No. 1207586. The connector 10 is engaged with a coaxial cable 24 and comprises a seal nut 12, a collar 14 defining a notch 80, a ferrule 18, a sleeve 20 having an outwardly projecting protrusion 76, and a seal ring 22. Upon axial compression of the connector 10 to close and secure the connector 10 to a coaxial cable 24, the seal ring 22 and the sleeve 20 slidingly engage and force a sealing device towards an outer insulator 32 of the coaxial cable 24 to provide an environmentally sealed portion thereof. The projecting protrusion 76 is engaged in the notch 80. However, the collar 14 and the ferrule 18 are both made of metal, which are elastic and may be easily deformed. When deformation happens, the projecting protrusion 76 cannot be fixed into the notch 80, and thus the coaxial cable 24 cannot be fixed. Additionally, when there is a manufacturing error in the collar 14 or the ferrule 18, the same problem will arise. All in all, once the projecting protrusion 76 cannot properly engage in the notch 80, the cable connector 10 will not be assembled securely.

U.S. Pat. No. 6,425,782 also discloses a connector for coaxial cable. An annular protuberance 213 is inlaid in an annular groove 45 so that the coaxial cable 15 is secured by an adapter 40. However, the connector 20 for connecting a coaxial cable to an electronic device is needed to be very small in size, so the protuberance 213 and the annular groove 45 must be produced accurately enough to match each other, which is difficult to be realized in manufacture.

Hence, synthetically consider the factors of deformation of metal, manufacturing error of the connector, manufacturing cost, and manufacturing complexity, etc, an improved coaxial connector is need in art to overcome the above-mentioned disadvantages of the coaxial connectors.

BRIEF SUMMARY OF THE INVENTION

Another object, therefore, of the present invention is to provide a coaxial connector for easy assembly.

A coaxial connector to be connected to a coaxial cable comprising a cable center conductor, a cable dielectric layer, a cable outer conductor and a cable jacket, comprises a nut, an sleeve comprising a tubular portion inserted between the cable dielectric layer and the cable outer conductor, and an outer flange fixed by the nut, a seal providing an environmental seal, a clamp comprising an clamp portion connected with the sleeve, and a ferrule comprising an inner surface slidingly engaged the cable jacket and an outer surface adapted for matching with an serrate inner surface of the clamp. When assembly, the ferrule can be successively inserted into an annular cavity defined by the clamp and the sleeve until the coaxial cable is fixed securely enough in the coaxial connector.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
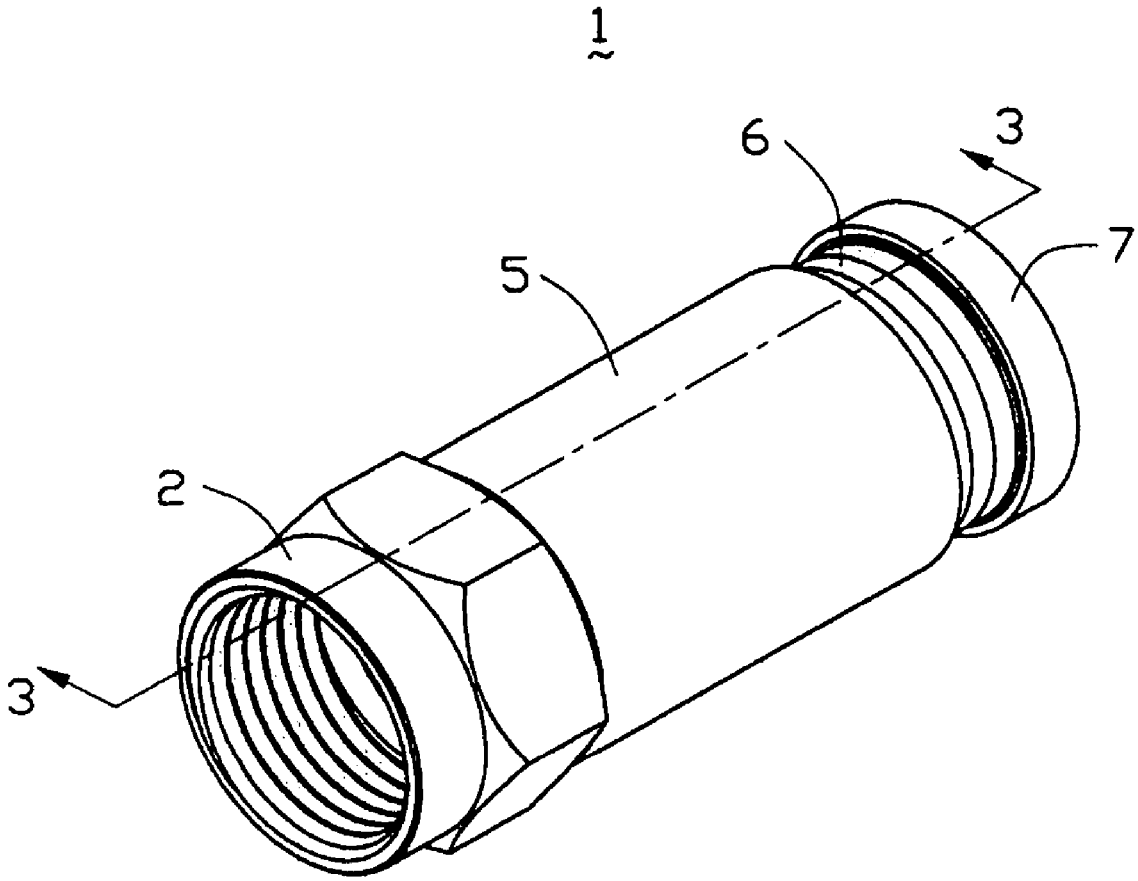
FIG. 1 is a perspective view of a coaxial connector according to the present invention.
Figure 2:
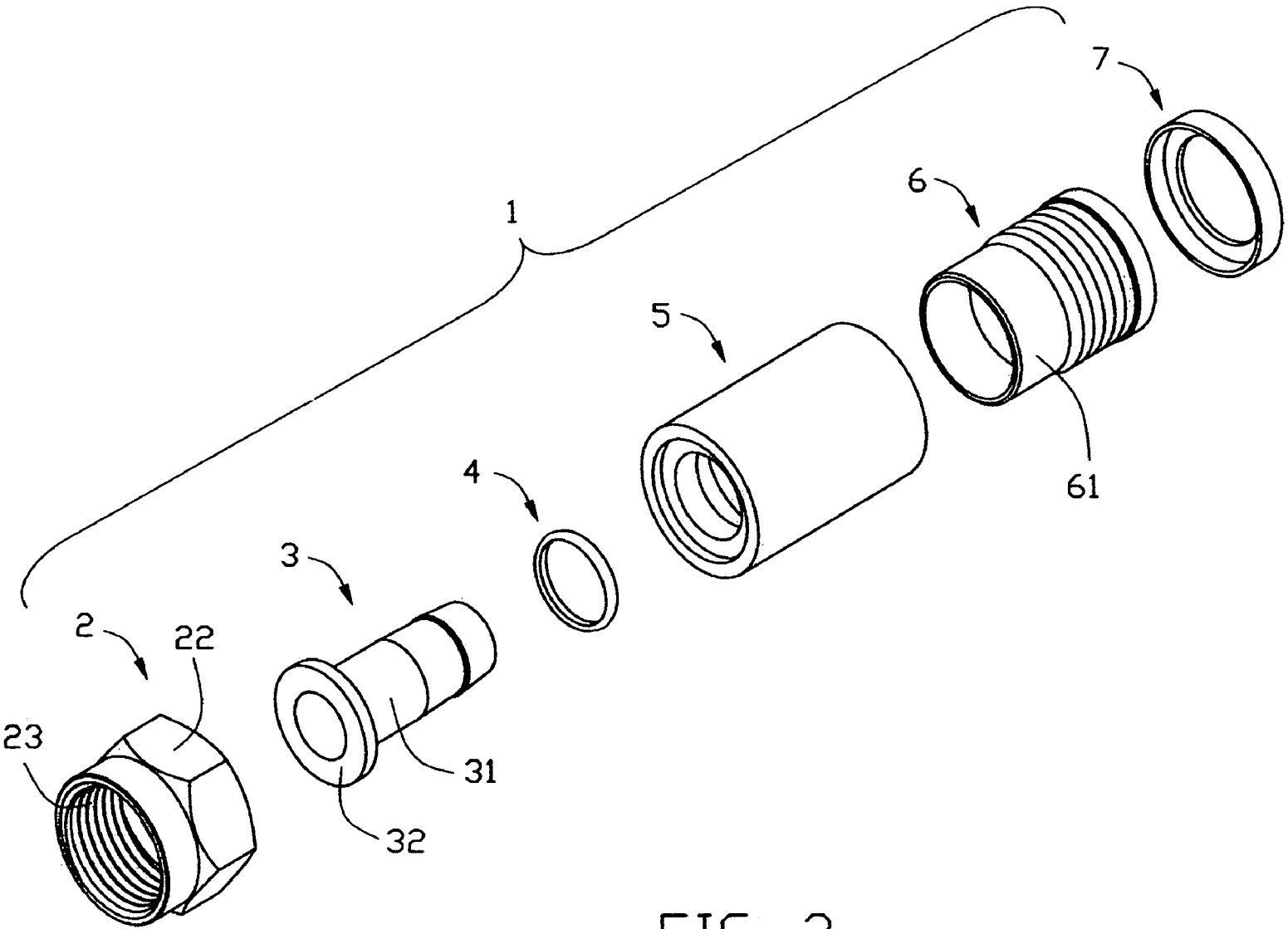
FIG. 2 is an exploded view of FIG. 1.
Figure 3:
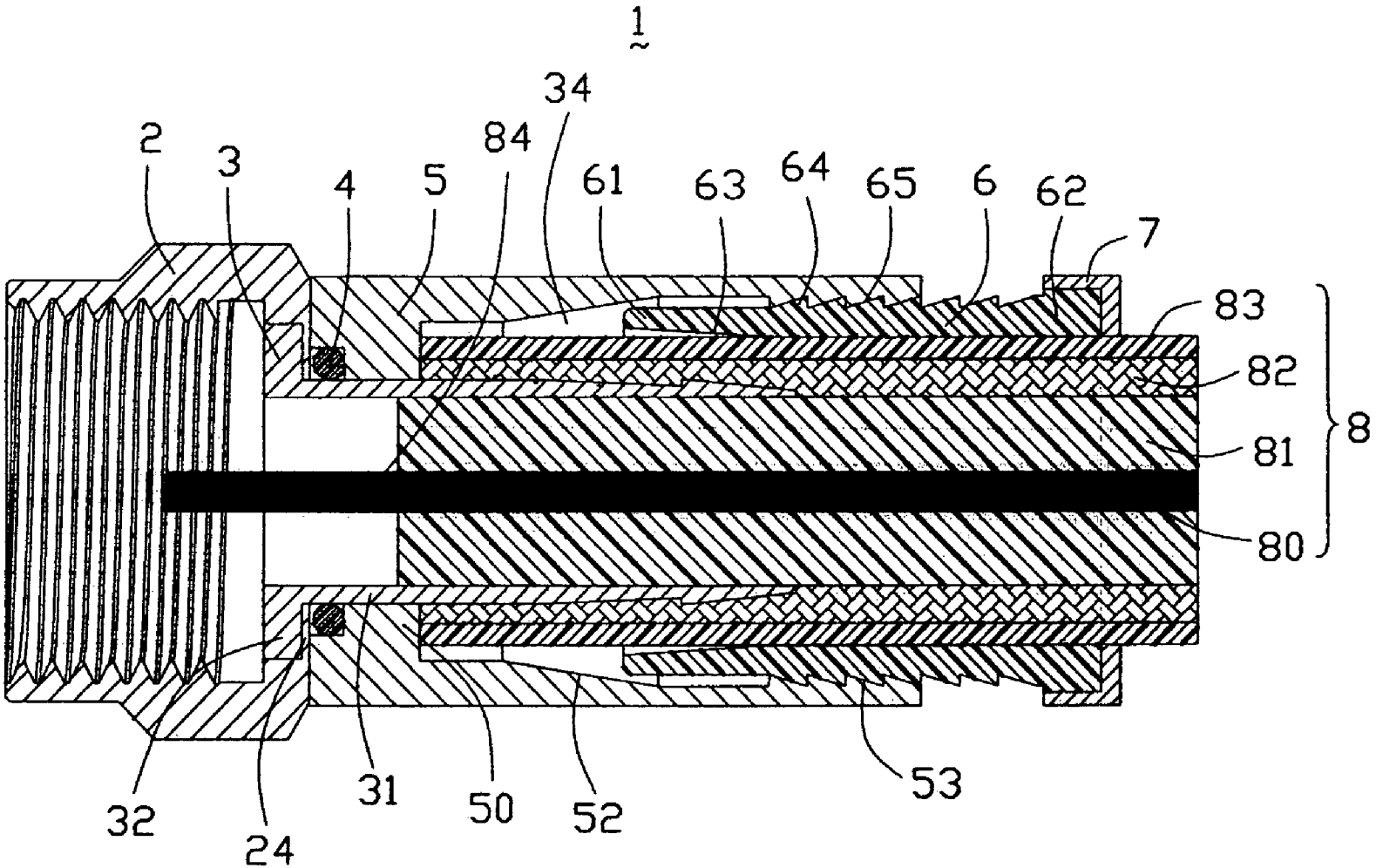
FIG. 3 is a cross-sectional view of the coaxial connector along line 3—3 of FIG. 1.

Referring to FIGS. 1–3, a coaxial connector 1 is elongate and comprises a nut 2, a sleeve 3, a seal 4, a clamp 5, a ferrule 6 and a cap 7. The coaxial connector 1 is usable for connecting a coaxial cable 8 to an electronic device (not shown) or a threaded interface connector (not shown). The coaxial connector 1 and the coaxial cable 8 form a connector assembly.

The coaxial cable 8 comprises a cable center conductor 80 capable for providing electrical signals therethrough. The cable center conductor 80 is typically formed form a conductive metal. Surrounding the cable center conductor 80 is a cable dielectric layer 81 which insulates the cable center conductor 80 to minimize signal loss. The cable dielectric layer 81 also maintains a spacing between the cable center conductor 80 and a cable outer conductor 82. The cable dielectric layer 81 is often made of plastic material. The cable outer conductor 82 is typically made of metal material. A cable jacket 83 surrounds the cable outer conductor 82 to further seal the coaxial cable 8 and is typically a plastic. A portion of the cable jacket 83, the cable outer conductor 82 and the cable dielectric layer 81 is removed from a forepart of the coaxial cable 8 to form an exposed portion 84.

The nut 2 is made of metal. An inner flange 24 is inwardly and radially extending from a rear end (not labeled) of the nut 2. As used herein, rear refers to a general direction longitudinally towards the coaxial cable 8. Oppositely, front refers to the direction towards the nut 2. Several screw threads 23 are provided on an inner surface of the nut 2, while an outer surface of the nut 2 is formed into a flat shaped screw nut 22 so that the coaxial connector 1 can be tightened to a receiver or a terminal electronic device with a spanner or other equivalent tools.

The sleeve 3 is made of metal and comprises an outer flange 32 formed at a front end thereof and a tubular portion 31 rearwardly extending from the outer flange 32. The outer flange 32 is adapted for physically locking and electrically connecting with the inner flange 24 of the nut 2. The tubular portion 31 is adapted for engaging an outer surface of the cable dielectric layer 81 of the coaxial cable 8.

The clamp 5 is an elongate hollow cylinder made of metal. The clamp coaxially encircles the sleeve 3. The front portion (not labeled) of the clamp 5 has a clamp portion 50 inwardly and radially extending therefrom to the sleeve 3. The middle portion (not labeled) of the clamp 5 has a slant inner wall 52 for pressing the ferrule 6. The rear portion (not labeled) of the clamp 5 has serrate inner wall 53 for fixing the ferrule 6. An annular cavity 34 is defined between the clamp 5 and the sleeve 3 for receiving the cable outer conductor 82, the cable jacket 83 and the ferrule 6.

The seal 4 is made of insulating material, which provides an environmental seal between the nut 2 and the clamp 5. The seal 4 is rightly sandwiched between the inner flange 24, the tubular portion 31 and the clamp portion 50.

The ferrule 6 is an elongate hollow tubule made of deformable material, such as plastic material. The ferrule 6 comprises an insertion portion 61 and a tail 62. The inner surface 63 of the ferrule 6 is flat and smooth for slidingly engaged the cable jacket 83, while the outer surface 64 thereof has a plurality of saw-teeth 65 thereon for matching with the serrate inner wall 53 of the clamp 5.

The cap 7 is ring-shaped and is made of metal. The cap 7 is provided for covering the tail 62 of the ferrule 6, further fixing the ferrule 6.

Figure 4:
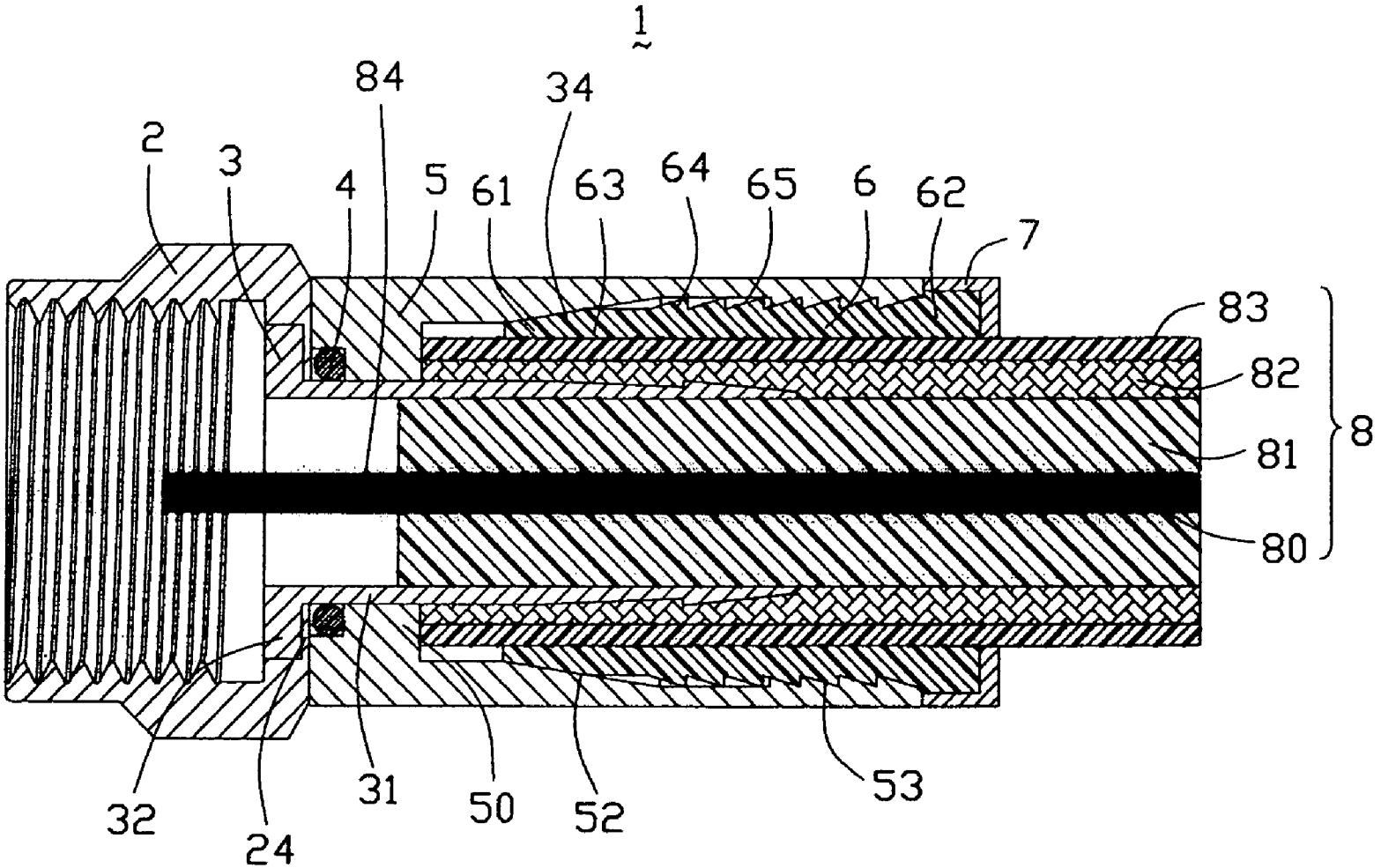
FIG. 4 is a cross-sectional view similar to FIG. 3 but with a ferrule completely inserting into a clamp.

Referring to FIGS. 3 and 4, when assembling, the sleeve 3 is inserted through the nut 2 from front to rear at first. The outer flange 32 of the sleeve 3 is rightly hooked by the inner flange 24 of the nut 2, while the tubular portion 31 stretches outside the nut 2. The seal 4 and the clamp 5 are successively smocked on the tubular portion 31 of the sleeve 3. The seal 4 is just sandwiched among the inner flange 24, the tubular portion 31 and the clamp portion 50 of the clamp 5.

Next, the coaxial cable 8 is inserted into the coaxial connector 1 while the cable center conductor 80 exposed outside to match with a central contact (not shown) and the cable dielectric layer 81 received in the sleeve 3. The tubular portion 31 is inserted between the cable dielectric layer 81 and the cable outer conductor 82 in order to reliably and electrically connect with the cable outer conductor 82.

Next, the ferrule 6 is axially inserted into the annular cavity 34 from rear to front and occludes with the clamp 5 via the saw-teeth 65. Along with the insertion of the ferrule 6, the insertion portion 61 is touched against the slant inner wall 52 of the clamp 5 and pressed inwardly by the slant inner wall 52 to be deformed, thus the coaxial cable 8 is pressed by the deformed ferrule 6. The ferrule 6 is successively inserted until the coaxial cable 8 is pressed securely enough in the coaxial connector 1. At last, covering the cap 7 on the tail 62 of the ferrule 6 for further fixing the ferrule 6 and the coaxial cable 8.

Various changes to the foregoing described structures and corresponding methods would now be evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A connector assembly comprising:

a coaxial cable comprising a cable center conductor, a cable dielectric layer, a cable outer conductor, and a cable jacket;

a nut;

a sleeve connected with the nut and having a tubular portion for inserting between the cable dielectric layer and the cable outer conductor;

a clamp having a clamp portion in a front portion thereof for enclosing the sleeve, and a slant inner wall in a middle portion thereof the clamp and the sleeve forming an annular cavity; and a ferrule adapted for axial sliding insertion into the annular cavity and secure engagement with the clamp.

2. The connector assembly as claimed in claim 1, wherein the clamp comprises a serrate inner wall in a rear portion thereof.

3. The connector assembly as claimed in claim 2, wherein the ferrule comprises an inner surface and an outer surface, the inner surface is slidingly engaged with the cable jacket, and the outer surface has a plurality of saw-teeth matching with the serrate inner wall of the clamp.

4. The connector assembly as claimed in claim 1, wherein the ferrule is made of deformable material.

5. A coaxial cable connector assembly comprising:

a coaxial cable defining inner and outer coaxial structures commonly extending along a first direction;

a sleeve extending along a second direction opposite to said first direction and having a front portion tightly sandwiched between said inner and outer structures of a front section of the cable;

a nut partially resistingly surrounding the sleeve and extending along said second direction;

a tubular clamp spatially and partially resistingly surrounding the sleeve and extending along said second direction;

a seal located abuttingly around the sleeve between the nut and the clamp; and a tubular ferrule coaxially surrounding the cable and extending in said first direction; wherein a front portion of said ferrule is radially located between the clamp and the sleeve, and locked with the clamp.

6. The coaxial cable connector assembly as claimed in claim 5, wherein said ferrule is sandwiched between an inner face of the clamp and an outer face of said outer structure of the cable.

7. The coaxial cable connector assembly as claimed in claim 6, wherein said outer structure of the front section of the cable is tightly sandwiched between the sleeve and said ferrule.

8. The coaxial cable connector assembly as claimed in claim 5, wherein a front end of said outer structure of the cable abuts against at least one of the clamp and the sleeve in said first direction so as to assure no further mutual relative movement between the cable and the sleeve.

9. The coaxial cable connector assembly as claimed in claim 5, wherein said ferrule is moveable relative to the clamp in said first direction for increasing tightness among the cable, said ferrule and the sleeve.

* * * * *